United States Patent [19]

Ewers

[11] 4,092,748

[45] June 6, 1978

[54] PATIENT HANDLING SYSTEM

[75] Inventor: Marion H. Ewers, Payson, Ariz.

[73] Assignee: Air Rotor Development Company, Inc., Payson, Ariz.

[21] Appl. No.: 705,810

[22] Filed: Jul. 16, 1976

[51] Int. Cl.[2] ..... A61G 7/10

[52] U.S. Cl. ..... 5/85; 5/82 R

[58] Field of Search ..... 5/82 R, 83, 85, 84

[56] References Cited

U.S. PATENT DOCUMENTS

| | | | |
|---|---|---|---|
| 319,283 | 6/1885 | Marsh | 5/85 |
| 529,301 | 11/1894 | Ortega | 5/82 |
| 885,307 | 9/1908 | Whaley | 5/85 |
| 901,370 | 10/1908 | Poppert | 5/85 |
| 1,962,042 | 6/1934 | Stevenson | 5/85 |
| 1,965,644 | 7/1934 | Heffelfinger | 5/187 |
| 1,977,944 | 10/1934 | Maskett | 5/84 |
| 2,418,606 | 4/1947 | Smith | 5/82 |
| 3,252,704 | 5/1966 | Wilson | 5/83 |
| 3,284,816 | 11/1966 | Laubsch | 5/81 R |
| 3,426,367 | 2/1969 | Bradford | 5/82 |
| 3,699,593 | 10/1972 | Orticker | 5/82 |

FOREIGN PATENT DOCUMENTS

| | | | |
|---|---|---|---|
| 332,865 | 7/1930 | United Kingdom | 5/82 |

*Primary Examiner*—Paul R. Gilliam
*Assistant Examiner*—Alex Grosz
*Attorney, Agent, or Firm*—Charles E. Cates

[57] ABSTRACT

A patient handling system is disclosed which includes a novel patient handling sheet and a novel patient lift apparatus and a combination thereof. The patient handling sheet has spaced parallel longitudinal tubes to receive stretcher poles and longitudinally spaced transverse apertures in the tubes to permit either the grasping of the stretcher poles by the hands or by hook means attached to the lifting apparatus or use of the apertures as hand holds without the stretcher poles. The apparatus for lifting stretchers is generally rectangular, is wide enough to straddle the patient's bed, and is hinged at each corner so that it may be folded up and stored away when not in use. A frame locking means is used to prevent its folding when in use. A crane is provided at one corner to do the lifting.

8 Claims, 11 Drawing Figures

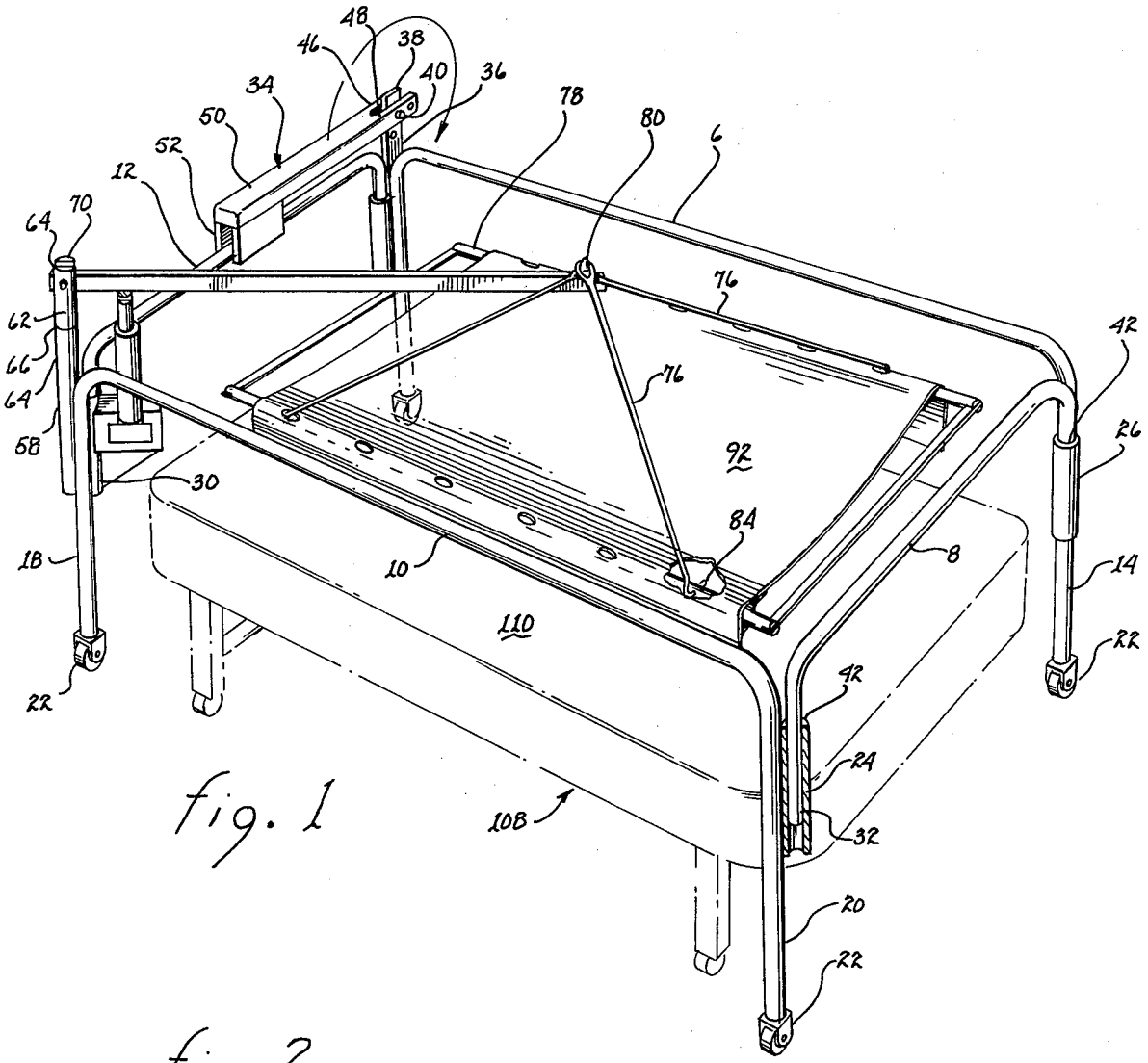
fig. 1
fig. 2
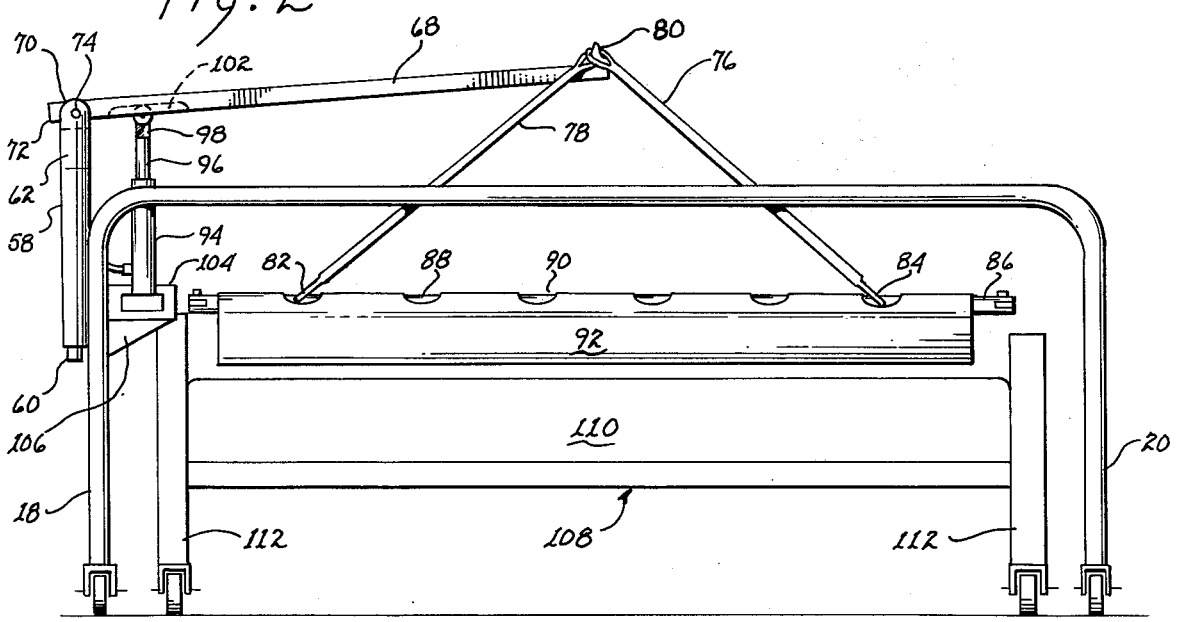

PATIENT HANDLING SYSTEM

BACKGROUND OF THE INVENTION

1. Field of the Invention

This invention relates to stretchers and machines for moving and otherwise handling invalid bed patients who are unable to move themselves or find it inconvenient to do so.

2. The Prior Art

Various means for moving patients from place to place either by hand or by the use of machines to do the lifting are known. The most familiar example is the common stretcher and the wheeled bed. There have been also sophisticated machines designed to lift stretchers bearing a patient off the bed for removal to another spot or to lift the patient by means of straps without stretchers.

Exemplary of prior art devices are the patents to Lane, U.S. Pat. Nos. 953,962; Hoyer, 2,821,406; Leininger, 1,889,925; Thompson, 771,846; Reuter, 2,272,778; Brouillette, 2,668,301; Conyers, 2,659,092; Hardy, 382,872; Reed, 292,048; Roush, et al, 1,085,704.

The prior art machines suffer from one or more defects, being either excessively complicated or impractical, inconvenient to use, or too bulky to store efficiently.

A desirable machine is convenient to use, sturdily built and has stability. However, storing such a machine is a problem when it is not in use. The prior art devices have not satisfactorily met these requirements.

The lifting and turning of patients in hospitals is necessary to prevent bed sores, to clean the patient and to administer treatment. However, the manual handling of patients by nurses is a significant source of back injuries to the nurses and a source of expense to hospitals because of resulting disabilities of the nurses. The nurses, needless to say, are adversely affected by the heavy labor and risk of injury in handling patients.

BRIEF SUMMARY OF THE INVENTION

This invention is in part an apparatus for lifting and transporting bed patients from and to hospital beds. The apparatus has a horizontally foldable rectangular frame which has hinges at its corners. When not in use it can be folded upon itself to take up a minimal amount of space for storage. The depth of storage required is about a foot which is convenient for storage in hospital hallways. While in use detent means prevent the folding of the frame from the rectangular position.

The apparatus also has hoist means for engaging a stretcher, preferably the patient handling sheet of this disclosure. The frame is supported by a plurality of legs, preferably four, which are spaced to permit straddling the patient's bed. This is advantageous because modern hospital beds do not accommodate the introduction of apparatus under the bed.

The frame is supported by legs above hospital bed height and has means for moving the apparatus attached to the legs. The resulting apparatus makes it possible for the frame to assume a position over the bed by moving in from the side or end of the bed, whichever is convenient. When the frame is in place the hoist means is engaged to lift a stretcher carrying the patient and thus transport the patient to and from the bed with a minimum of patient handling.

An important sub-combination of the invention which completes the system when used with the lifting apparatus described above is the patient handling sheet which is used in moving and turning bed patients either by hand or by use of the lift apparatus.

The patient handling sheet is a sheet of bodysupporting material having spaced sets of multiple longitudinal folds on each side of the sheet. The folds are stitched to each other at their edges in parallel longitudinal rows such that they make a tube longitudinally of the bed sheet. Preferably the tubes are spaced apart slightly wider than the patient's bed so that the tubes lie just below the top of the bed and to the side and do not interfere with the patient's comfort.

Transversely through the tubes are placed apertures, preferably reinforced, which are spaced apart at convenient distances. Six spaced apertures may be placed on each side so that if need be three persons can stand on either side of the bed and assist the handling in case the patient is to be moved and turned manually and the patient is very heavy. If the lifting apparatus is desired stretcher poles may be inserted longitudinally in the folds or tubes and these stretcher poles can be engaged by hand or by hooks attached to the lifting apparatus. In either case the stretcher poles are engaged through the apertures. In combination, the lifting apparatus above described is used with the patient bed handling sheet for excellent results.

The patient handling sheet reinforced by stretcher poles may be used independently of the lift apparatus of this invention or with other lift apparatus. For example, in a helicopter rescue of an injured party. The stretchered sheet can be hoisted with the injured patient aboard. The patient can be transferred to emergency ward, x-ray, and hospital bed seriatim without removing him from the sheet.

The sheet alone may be used in place for patient turning. This is a problem in hospitals if the patient is immobilized and cannot turn himself. Even quite heavy patients may be turned on their side by using the apertures to grip the sheet and pull upward.

DETAILED DESCRIPTION OF THE PREFERRED EMBODIMENTS

A fuller understanding of the invention will be obtained by reference to the drawings in which:

FIG. 1 is a perspective view of the patient handling system.

FIG. 2 is a side elevation of the system of FIG. 1 showing the apparatus of the system in place over a standard hospital bed.

Figure 3:
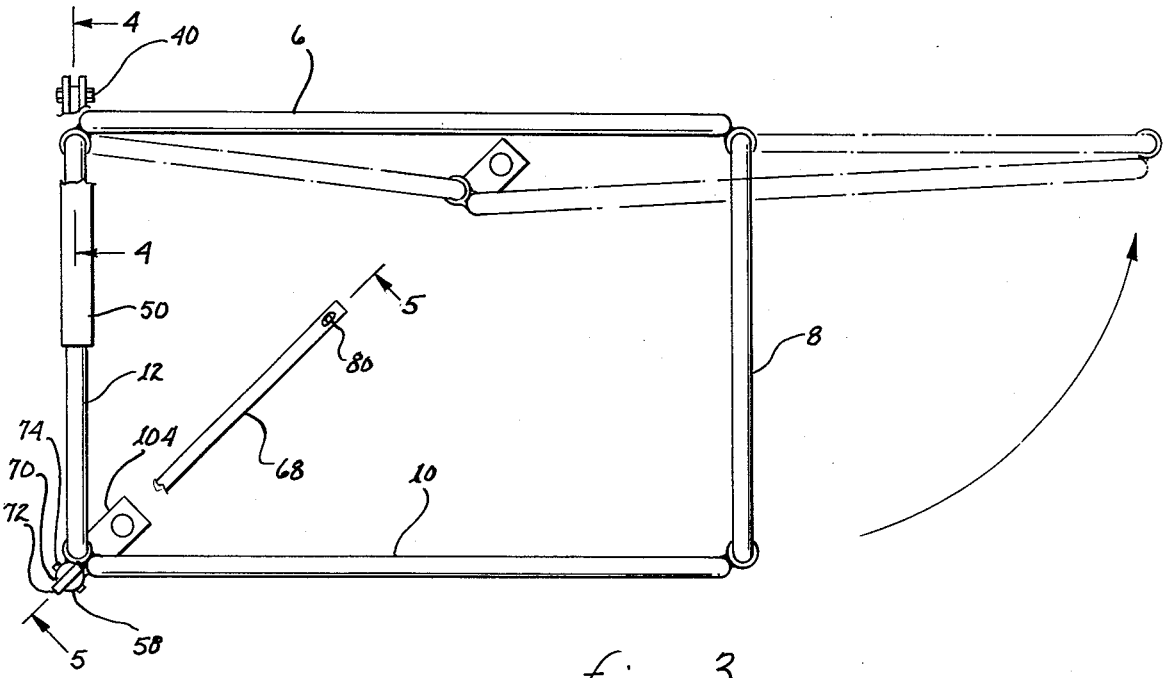
FIG. 3 is a plan view of the lifting apparatus, partly broken away, with the collapsed apparatus shown in phantom outline.

Turning now to FIG. 1 wherein a preferred embodiment of the lifting apparatus is shown, the frame therein is made of four U-shaped frame members 6, 8, 10, 12. Side frame members 6, 10 are opposed to each other and form the longitudinal sides of a rectangle. They are inverted "U"s whose respective legs 14, 16 and 18, 20 provide the means for supporting the frame. Attached to the ends of the legs are casters 22 which are of a conventional type and will not be described in detail.

End frames 8 and 12 are attached to side frames 6 and 10 by means of hinge sleeves 24, 26, 28, 30 into which receive the ends 32 of the end frames. A collar 42 provides a stop means to determine position of the end frames 8, 12. When not in use the lifting apparatus can be folded on itself such that side frames 6, 10 are touching each other. In this position the apparatus takes up about one foot in depth of storage space and can be easily stored, for example, against the wall of a hospital hallway, without interfering with transportation of patients and vehicles.

Figure 4:
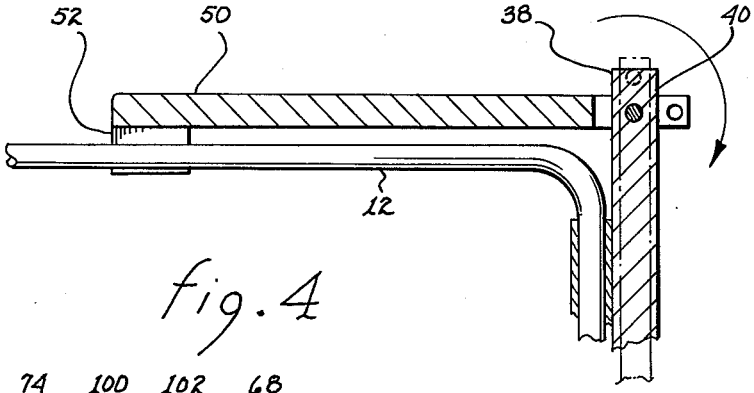
FIG. 4 is a partial view of the apparatus of FIG. 3 along the lines 4—4.

When in use the frames are prevented from folding upon each other by means of the frame locking arm 34 shown in FIG. 1 and in detail in FIG. 4. The frame locking arm has a standard 36 welded to the leg 16 of side frame 6. The standard has a tab 38 near its upper end which is pierced to receive a pin 40 which also engages the apertures in two fingers 46, 48 in an arm 50. By this means the arm is permitted to pivot 270° between the horizontal locking position and the vertical storage position. In the horizontal position two legs 52, 54 engage the side frame 12. While so engaged the end frame 12 cannot fold toward the side frame 6.

A tubular standard 58, circular in cross section, is welded to leg 18 and hinge sleeve 30. This standard is sized to receive and closely fit a rod 60 to the upper end of which a tubular sheath 62 is welded. The abutting ends 64, 66 of the standard 58 and sheath 60 serve to support sheath 62 and its associated lifting arm 68. The sheath and attached rod 60 can swivel freely by means of this arrangement. A slot 64 in the end of the sheath 62 receives the shaped end 72 of the lifting arm 68. The end 70 of the sheath 62 and the end 72 of the lifting arm 70 are broached to receive a pin 74 from which the lifting arm can pivot.

Turning now to FIG. 2 the operation of the crane in the lifting of a patient handling sheet of this invention is illustrated. The lifting arm 68 is attached with straps 76, 78 which have counter parts on the other side. The straps 76, 78 are secured to a boss 80 on the upper side of the lifting arm 68 at the first ends of the strap 76, 78. The second ends of the strap 76, 78 terminate in hooks 82, 84 which serve to engage the stretcher pole 86 which appears through apertures 88, 90 in a patient handling sheet 92.

When the hydraulic jack 94 is activated the piston 96 extends and retracts to raise and lower the lifting arm 68. The end 98 of the piston 96 is equipped with a roller 100 which follows in a groove 102 in the underside of the lifting arm. The hydraulic jack 94 is secured by a bracket 104 welded securely to leg 18 and sleeve 30 and reinforced by triangular support piece 106 welded to the same members. The number 108 indicates the patient bed generally. For purposes of illustration the patient handling sheet 92 is raised above the bed's mattress 110 so that the relationship of the bed to the patient lifting device can be clearly seen. In FIG. 2 the legs 18, 20 are straddling the legs 112 of the patient bed 108.

Figure 5:
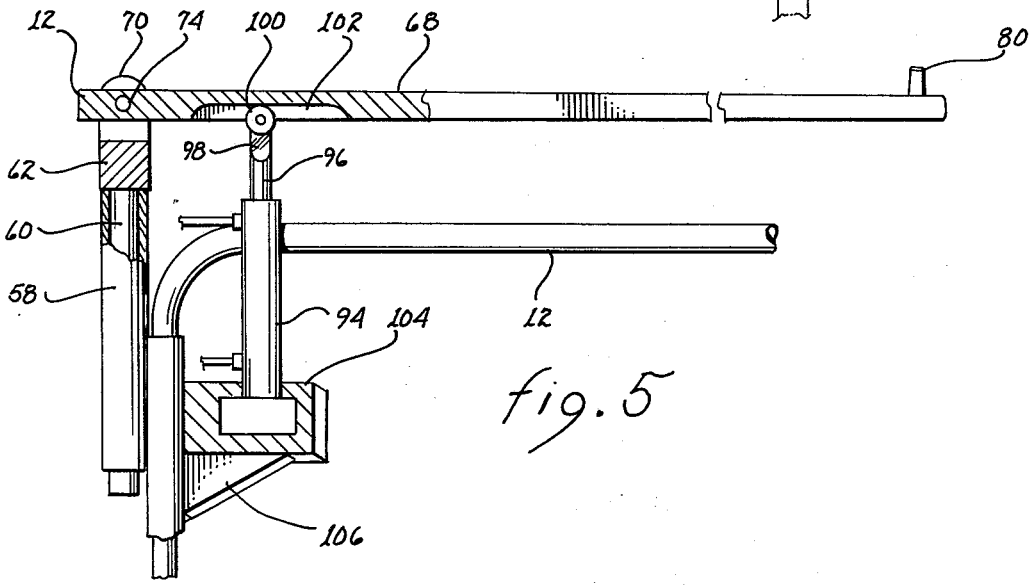
FIG. 5 is a partial view of the apparatus of FIG. 3 along the lines 5—5.
Figure 7:
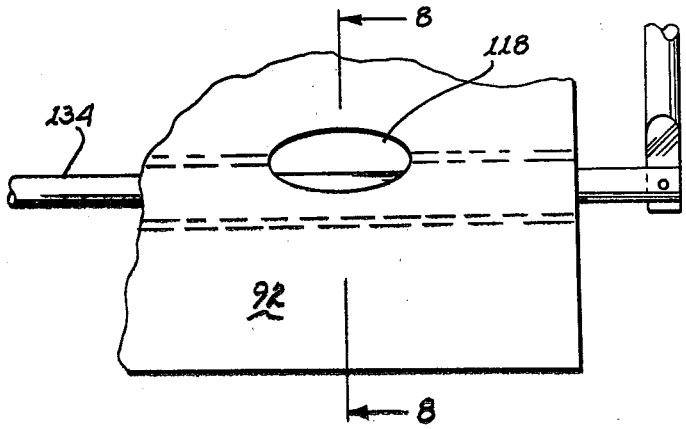
FIG. 7 is a part of the sheet of FIG. 6 in magnified view.

FIG. 7 shows the frame in the open and collapsed positions (in phantom outline). The bracket 104 is shown welded to the leg 18 and sleeve 30 as is the standard 58, but opposite the standard. These details can also be seen in FIG. 5.

Figure 6:
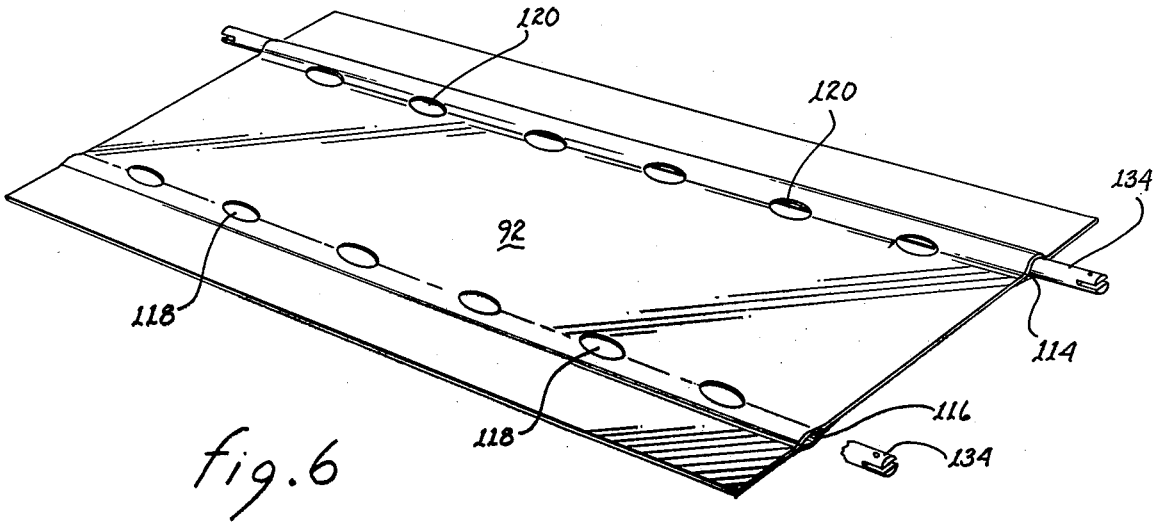
FIG. 6 is a perspective view of the patient handling sheet.
Figure 8:
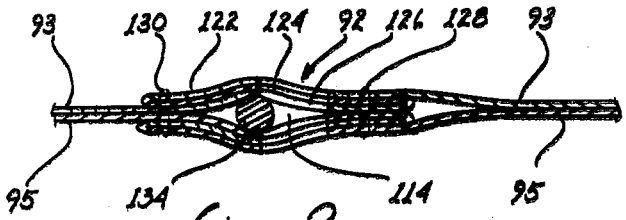
FIG. 8 is a cross-section of the sheet of FIG. 7 taken along the lines 8—8.

In FIG. 6 the patient handling sheet 92 is shown. The tubes are indicated at 114, 116. The apertures transverse the tubes are indicated at 118, 120. FIG. 8 is a cross-section of FIG. 6. The tube 114 is enlarged and will be referred to for further explanation. In this embodiment each layer 93, 95 of a double layer sheet 92 has been folded once and then folded again. The first fold, represented by layers 122, 124, has been laid back over section 126. The folds are heavily stitched at points 128, 130. This provides a tube 114.

Referring now to tube 114 which is shown with a stretcher pole 134 in place, it can be seen that the stretcher pole is firmly supported with respect to the sheet 92 by the tube folds above the stretcher pole.

Figure 9:
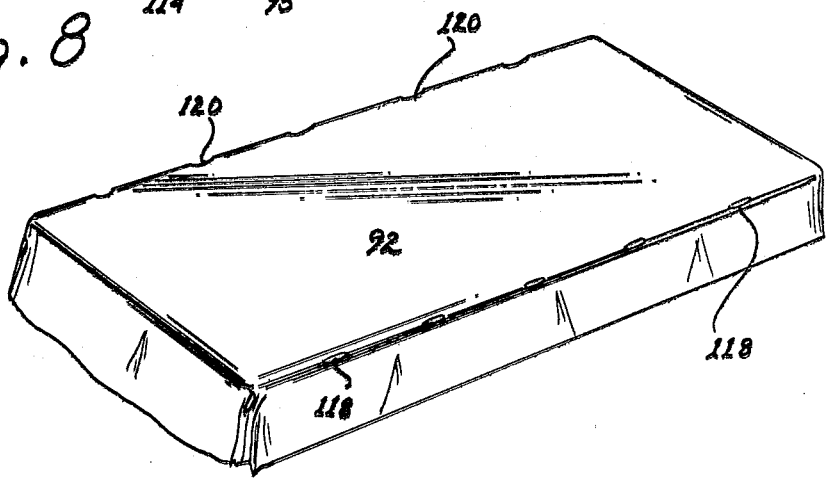
FIG. 9 is a perspective view of the patient handling sheet shown in place on a bed.

In FIG. 9 a preferred embodiment which spaces the apertures slightly wider than the width of the patient's bed is shown. By this means the stitching and extra thickness of the tubes do not interfere with the patient's comfort. By the same token it can be easily grasped by nurses and other hospital personnel to lift or turn a patient who cannot turn himself. By means of apertures 118, for example, one nurse can lift upward gently to turn a patient over on his side.

Figure 10:
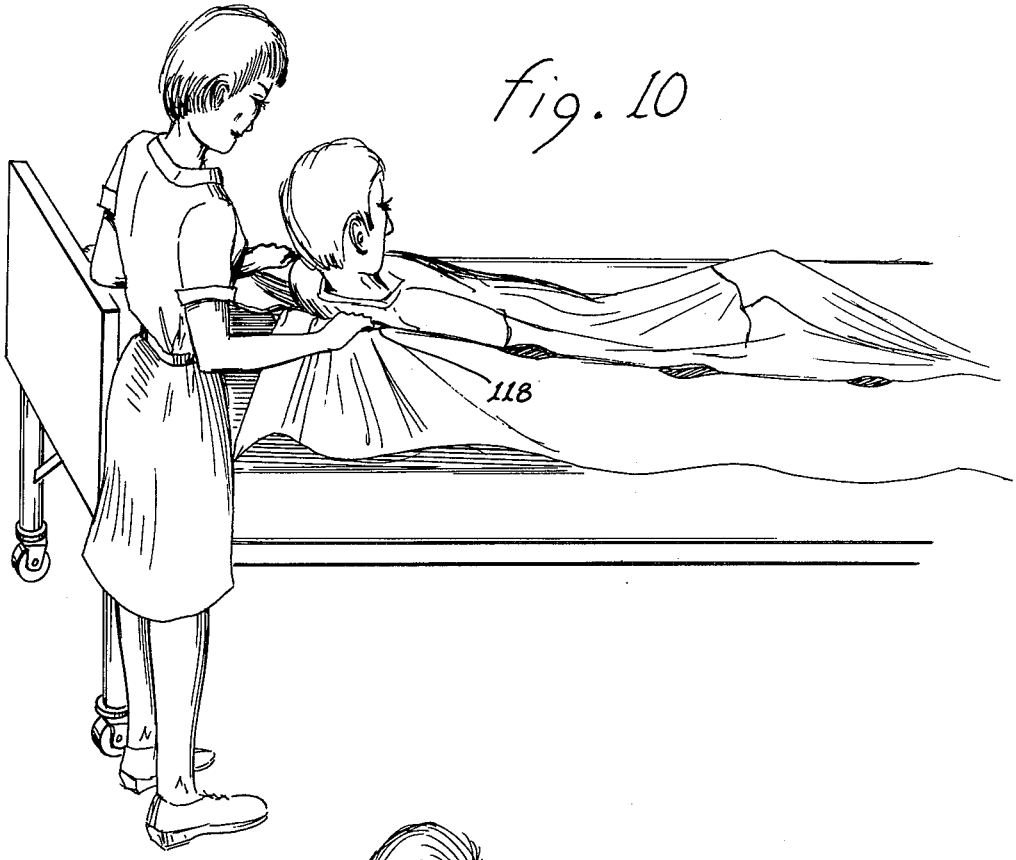
FIG. 10 shows a nurse lifting a patient by means of the patient handling sheet.

In FIG. 10 the lifting of a patient to a sitting position is illustrated. The nurse reaches across and engages the apertures and lifts the patient up for the doctor's examination or for further support in the sitting position.

Figure 11:
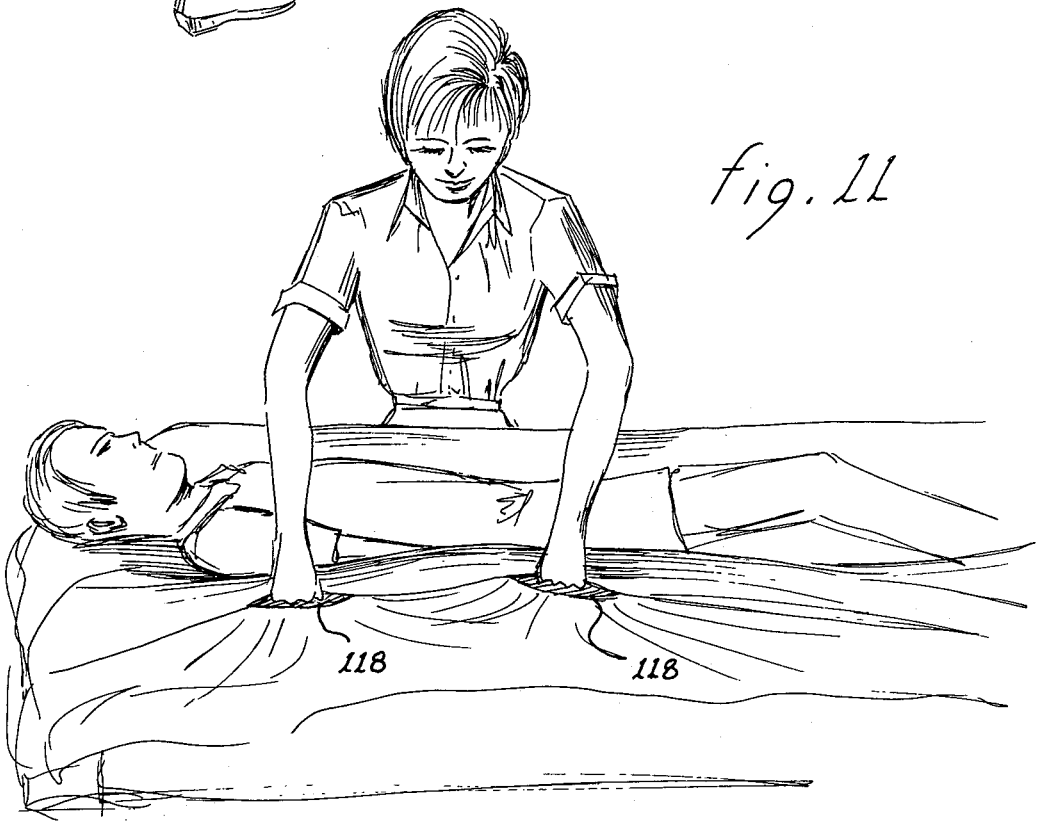
FIG. 11 shows a nurse turning a patient over in bed by means of the patient handling sheet.

In FIG. 11 the nurse is gently turning the patient to his side by reaching across with both hands to engage the sheet 92 by apertures 118. She pulls the edge of the sheet toward her to turn the patient.

Frequent turning of patients in a hospital bed is necessary to prevent bedsores from forming. By the means of this invention the nurse can easily turn a patient of moderate size and weight by herself. This should result in a considerable savings in accidental injury to the backs of the hospital personnel.

The foregoing preferred embodiments of this invention are exemplary but it is to be understood that various departures, modifications and alternatives can be employed without departing from the spirit of the invention which is defined by the attached claims.

I claim:

1. Apparatus for lifting and transporting bed patients from and to hospital beds comprising a stretcher a horizontally foldable rectangular frame having corner hinges, detent means to prevent folding of the frame from the rectangular position in use, hoist means carried by said frame and having means for engaging said stretcher a plurality of legs straddling the bed and supporting said frame above hospital bed height and means for moving the apparatus attached to said legs; whereby the frame may be positioned above the bed of a patient and the hoist means attached to the stretcher and the patient lifted up and transported, and whereby the apparatus may be folded for storage.

2. The apparatus of claim 1 wherein the hoist means comprises an arm pivotally connected to said frame, a piston having a rod which bears on the underside of said arm, means for moving said rod.

3. The apparatus of claim 1 wherein the said piston is hydraulic, said arm has a longitudinal trough guide on its underside and said rod has a follower at its end which rides in said guide.

4. The apparatus of claim 1 wherein the locking means is an arm rotatably hinged to one corner and having means for securing the free end of said arm.

5. The apparatus of claim 2 wherein said stretcher comprises a patient handling sheet for use in moving and turning bed patients comprising a sheet of body supporting material having two spaced sets of a plurality of longitudinal folds stitched at their edges in parallel longitudinal rows to make a tube in each set, and spaced transverse apertures through said tubes such that said apertures may serve as hand holds and stretcher pole may be inserted longitudinally in said folds and engaged through said apertures.

6. The apparatus of claim 5 wherein said sheet is a double layered sheet.

7. The apparatus of claim 6 wherein said longitudinal folds are disposed slightly wider than the bed.

8. Apparatus of claim 1 wherein said moving means comprises wheels.

* * * * *